US005791249A

United States Patent [19]

Quadracci

[11] Patent Number: 5,791,249

[45] Date of Patent: Aug. 11, 1998

[54] SYSTEM AND METHOD FOR REGULATING DAMPENING FLUID IN A PRINTING PRESS

[75] Inventor: Thomas A. Quadracci, Brookfield, Wis.

[73] Assignee: Quad/Tech, Inc., Sussex, Wis.

[21] Appl. No.: 825,252

[22] Filed: Mar. 27, 1997

[51] Int. Cl.[6] ..... B41F 1/18

[52] U.S. Cl. ..... 101/450.1; 101/147

[58] Field of Search ..... 101/147, 148, 101/450.1, 365, 483

[56] References Cited

U.S. PATENT DOCUMENTS

| | | | |
|---|---|---|---|
| 4,541,336 | 9/1985 | Bernauer | 101/365 |
| 4,553,478 | 11/1985 | Greiner et al. | 101/426 |
| 4,575,249 | 3/1986 | Grieger | 101/365 |
| 4,639,776 | 1/1987 | Fuerster et al. | 101/365 |
| 4,649,502 | 3/1987 | Keller et al. | 101/365 |
| 4,655,135 | 4/1987 | Brovman | 101/365 |
| 4,656,941 | 4/1987 | Brovman | 101/365 |
| 4,665,496 | 5/1987 | Ott | 101/315 |
| 4,722,274 | 2/1988 | Jeschke et al. | 101/148 |
| 4,899,653 | 2/1990 | Michl et al. | 101/148 |
| 4,972,774 | 11/1990 | MacPhee | 101/450.1 |
| 5,010,812 | 4/1991 | Rodi et al. | 101/148 |
| 5,010,820 | 4/1991 | Löffler | 101/484 |
| 5,014,618 | 5/1991 | Zingher et al. | 101/365 |
| 5,090,316 | 2/1992 | Rodi et al. | 101/148 |
| 5,185,644 | 2/1993 | Shimoyama et al. | 101/365 |
| 5,265,527 | 11/1993 | Tedford | 101/148 |
| 5,341,734 | 8/1994 | Jeschke et al. | 101/148 |
| 5,429,046 | 7/1995 | Shiba et al. | 101/148 |
| 5,520,113 | 5/1996 | Joss et al. | 101/484 |
| 5,568,769 | 10/1996 | Leuerer | 101/450.1 |

*Primary Examiner*—Eugene H. Eickholt
*Attorney, Agent, or Firm*—Michael, Best & Friedrich

[57] ABSTRACT

A method of and apparatus for controlling the amount of ink and water supplied to the plate cylinder of a web offset press. The web offset press operates to print an image on a travelling substrate and the method includes the steps of: (A) monitoring a characteristic of the substrate; (B) changing by a known quantity the amount of ink supplied to the plate cylinder in response to said monitored characteristic; (C) monitoring the change in the characteristic after the step (B) to determine whether the density of ink supplied to the substrate has changed in response to the step (B); and (D) decreasing the amount of water supplied to the plate cylinder when the monitored characteristic does not change in response to the step (B).

7 Claims, 8 Drawing Sheets

SYSTEM AND METHOD FOR REGULATING DAMPENING FLUID IN A PRINTING PRESS

BACKGROUND OF THE INVENTION

The present invention relates generally to a system and method for controlling the amount of dampening fluid supplied to the plate cylinder of a printing press. More particularly, the invention relates to a system for accurately monitoring color by measuring the reflectance and/or the optical density of color test strips printed on a web, and using the color information to control the amount of dampening fluid supplied to the plate cylinder.

In web offset printing, a high quality black and white or multi-color image is printed on a web such as paper moving at a high rate of speed. A lithographic plate is mounted to a rotating plate cylinder and ink is applied to the plate and subsequently transferred to the web via a blanket cylinder. In order to separate the print areas of the lithographic plate from the non-print areas, the print areas are made oleophilic and the non-print areas are made hydrophilic. For example, the non-print areas are anodized aluminum, as is known in the art. Thus, when ink and a dampening fluid such as water are applied, the ink is attracted to the oleophilic areas and the water is attracted to the hydrophilic areas.

More specifically, the ink is injected onto an ink pickup roller and from there is conveyed through a series of transfer rollers which spread the ink uniformly along their length and transfer the ink to the image areas of the rotating plate cylinder. Preferably, just enough ink is applied to the plate to form an array of ink dots on the plate. The plate cylinder rotates in contact with a blanket cylinder which transfers the ink from the plate cylinder to the moving paper web.

Similarly, water is applied to a fountain roller and is conveyed through one or more transfer rollers to the non-image areas of the plate. The water is used as a dampening fluid. The purpose of the dampening fluid is to optimize the quality of the printed image. However, because the water and the ink are immiscible, a proper amount of water is required to keep the ink in desired print areas. If an insufficient amount of water is supplied to the plate, the ink dots become larger than desired because the ink spreads out more. On the other hand, if too much water is supplied, the ink becomes emulsified and does not transfer properly to the web. In either case, the quality of the resultant printed image is degraded.

The optimum amount of dampening fluid required is dependent on several factors, including the speed of the press, the ambient temperature, and the type of paper used in the printing process. For example, at higher press speeds, the plate cylinder and blanket cylinder transfer ink and water to the paper web at a higher rate, and the inking and dampening systems must supply more ink and water. Also, as the ambient temperature is increased, some of the water evaporates, and thus it is necessary to increase the amount of water supplied. Similarly, more water needs to be supplied if the paper used in the press run is highly absorbent.

Water control has historically been performed manually by a trained pressman, who visually monitors the printed image as well as the sheen of the plate cylinder and adjusts the amount of water supplied accordingly. This technique however requires much training and is prone to human error. As a result, various attempts have been made to provide an automatic system for monitoring the amount of dampening fluid used in order to properly control the amount of dampening fluid supplied to the plate cylinder. For example, attempts have been made to measure the water content of the ink, the amount of water on the plate, and even the reflectivity of the plate, in order to control the amount of water supplied to the plate cylinder.

Another system for automatically regulating the amount of water fed to the plate cylinder of an offset printing machine includes a sensor for determining the amount of water on the printing plate, a controller responsive to the sensor measurement for determining a control signal, and a dampening ductor whose speed is responsive to the control signal. The ductor operates to increase or decrease the amount of water on the printing plate. See for example, U.S. Pat. No. 5,520,113.

It is also known in the printing industry, to control color registration offset and other parameters in color printing processes by scanning a test image either off-line or on-line of the web printing process. For example, optical density measurements are performed by illuminating a test image with a light source and measuring the intensity of the light reflected from the image. Optical density (D) is defined as:

$$D=-\log_{10}(R)$$

where R is the reflectance, or ratio of reflected light intensity to incident light intensity.

The test image which is measured is often in the form of color test strips or color bars, which are known in the art. These color bars are comprised of individual color patches of varying ink color and tone having dimensions approximately 0.2 inches by 0.2 inches, with the color bars laid out in a row adjacent one another. The color bars are often printed in the trim area of the web and may be utilized for registration as well as color monitoring purposes.

A color video camera is ideal for measuring optical density on-line because many points can be measured at the same time and precise alignment of the camera with the test area is not necessary.

SUMMARY OF THE INVENTION

Prior art systems using a closed loop control to regulate the amount of dampening fluid supplied to the plate cylinder have failed because, when too much water is supplied to the system, the ink control portion of the system will increase the ink flow to the plate cylinder. As there is already too much water, the additional volume of ink will emulsify instead of transferring properly to the web. As a result, the system will continue to feed increasing volumes of ink to the printing plate in a fatal attempt to solve the problem.

Accordingly, the invention provides a system and method for using measurements of reflectance and/or optical density of color bars printed on a web or substrate in order to independently control the quantity of water and ink supplied to the printing plate cylinder. The system will measure a selected portion of the printed web. While the selected portion could be a printed color bar or a predetermined portion of the printed image and could be located at any place on the web, in one embodiment, the selection portion of print is located at a position on the printing plate that is effected by too little water before any other portion of the plate is effected by the condition of too little water. The selected swatch is designed to indicate when too little water is being applied to the printing plate and is called a "dry up indicator". In still another embodiment, the area of the plate responsible for printing the swatch will be treated to make it less receptive to water than the rest of the printing plate. This would guarantee that the area of the printing plate responsible for printing the swatch would be affected first by a low water condition. Additionally, the system preferably uses the same sensor to measure the amount of water being supplied to the plate and to determine the amount of ink being supplied to the plate. No other sensing device is required. The sensing device is mounted on a transport that travels across the web and that takes readings of the color swatch to measure reflectance and/or optical density of the color swatch.

The system includes a computer implementing a software algorithm to test for proper water amount. If the system changes ink key position to increase ink density but does not see a corresponding change in the optical density of the printed swatch, the assumption can be made that the water application level is too high. The computer then decreases the amount of water applied to the printing plate and inspects the swatch to see if there is a corresponding change in the optical density of the swatch printed on the web. Therefore, by inspecting the solid ink density and the "dry up indicator", it is possible to properly adjust the ink/water balance to control optical density of the printed web.

The invention also provides a system for controlling the amount of water supplied to the plate cylinder of a web offset press, the web offset press operating to print an image on a travelling substrate. The system includes a camera assembly positioned with respect to the substrate so as to receive light reflected from the substrate, the camera assembly including means for producing a signal, a computer for receiving the signal from the camera assembly and including processing means for determining the ink clarity of the image, said computer producing an ink control signal and ink control means for controlling the amount of ink supplied to the plate cylinder.

The invention further provides a method for controlling the amount of water and ink supplied to the plate cylinder of a web offset press, the method comprising the steps of monitoring a reflectance or optical density characteristic of the substrate, changing, by a known quantity, the amount of ink supplied to the plate cylinder in response to the monitored characteristic, monitoring the change in the characteristic after changing the amount of ink to determine whether a change in ink density applied to the substrate has changed in response to the change in the amount of ink, and, when the characteristic does not change in response to the change in the amount of ink applied to the plate cylinder, decreasing the amount of water supplied to the plate cylinder.

Various features and advantages of the invention are set forth in the following detailed description and claims.

BRIEF DESCRIPTION OF THE DRAWINGS

FIG. 5(*b*) illustrates image signal array captured by the camera assembly of FIG. 7.

Figure 1:
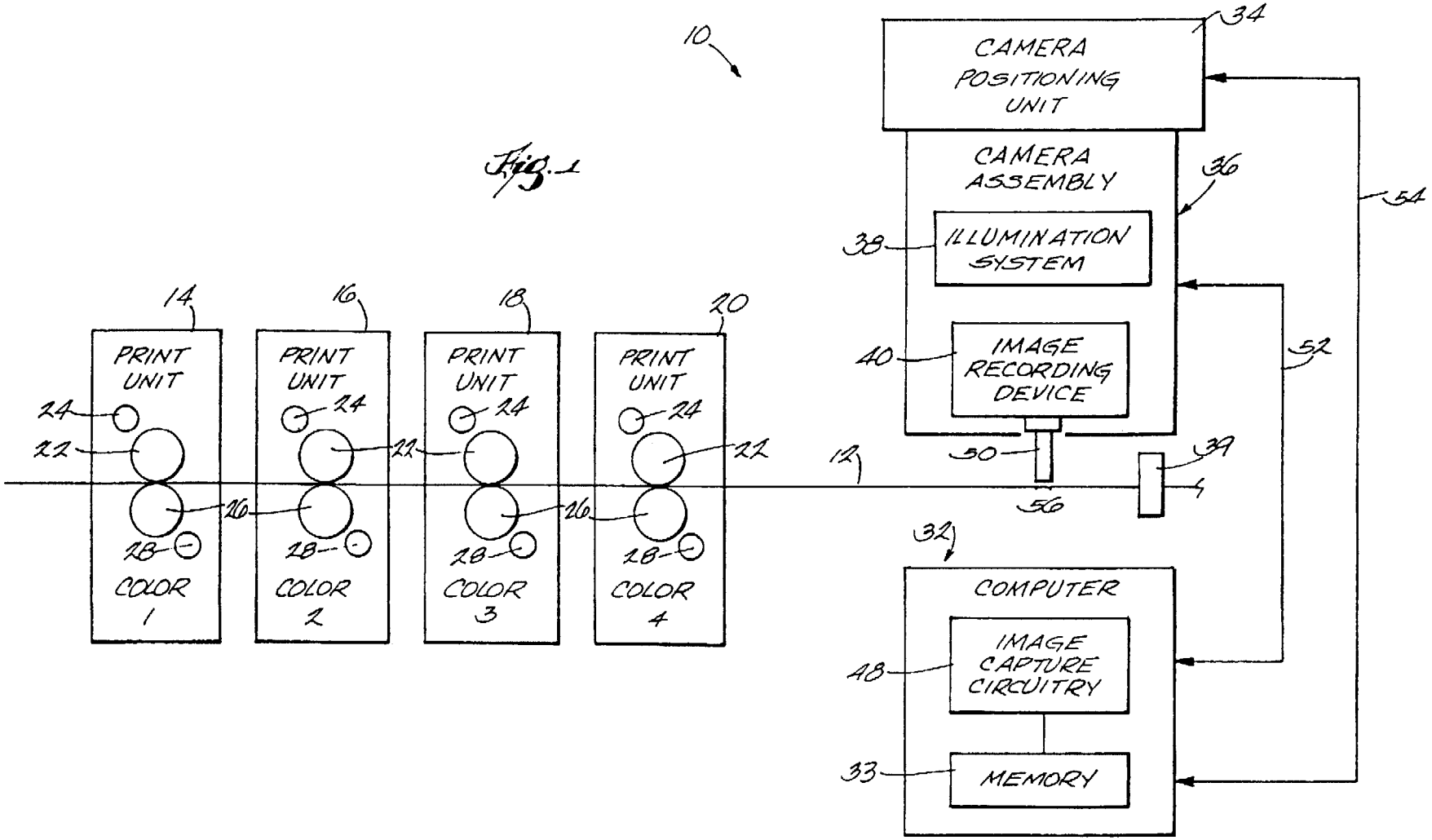
FIG. 1 is a block diagram of a web offset printing system.

Before one embodiment of the invention is explained in detail, it is to be understood that the invention is not limited in its application to the details of the construction and the arrangements of the components set forth in the following description or illustrated in the drawings. The invention is capable of other embodiments and of being practiced or being carried out in various ways. Also, it is to be understood that the phraseology and terminology used herein is for the purpose of description and should not be regarding as limiting.

DESCRIPTION OF THE PREFERRED EMBODIMENT

Referring to FIG. 1, a printing system 10 for printing a multi-color image upon a substrate or web 12 is illustrated. In the preferred embodiment, four printing units 14, 16, 18, and 20 each print one color of the image upon the web 12. This type of printing is commonly referred to as web offset printing. Each print unit 14, 16, 18 and 20 includes an upper blanket cylinder 22, an upper printing plate cylinder 24, a lower blanket cylinder 26, and a lower printing plate cylinder 28. In printing system 10, colors 1, 2, 3, and 4 on units 14, 16, 18, and 20 respectively, are typically black (K), cyan (C), magenta (M), and yellow (Y). The location of printing units 14, 16, 18, and 20 relative to each other is determined by the printer, and may vary.

The system 10 also includes a series of 24 to 36 keys (not shown) that control the application of ink to the plate cylinders 24 and 28. Each key controls the application of ink across an approximately one inch wide section of the plate cylinders 24 and 28. A change of key position will result in a change in the amount of ink applied to the corresponding approximately one inch of the plate cylinders 24 and 28. System 10 also includes a camera assembly 36 in optical communication with the web 12. As will be discussed in greater detail later in the specification, the camera assembly 36 enables the system to calculate the optical density of the image printed on the substrate.

Figure 2:
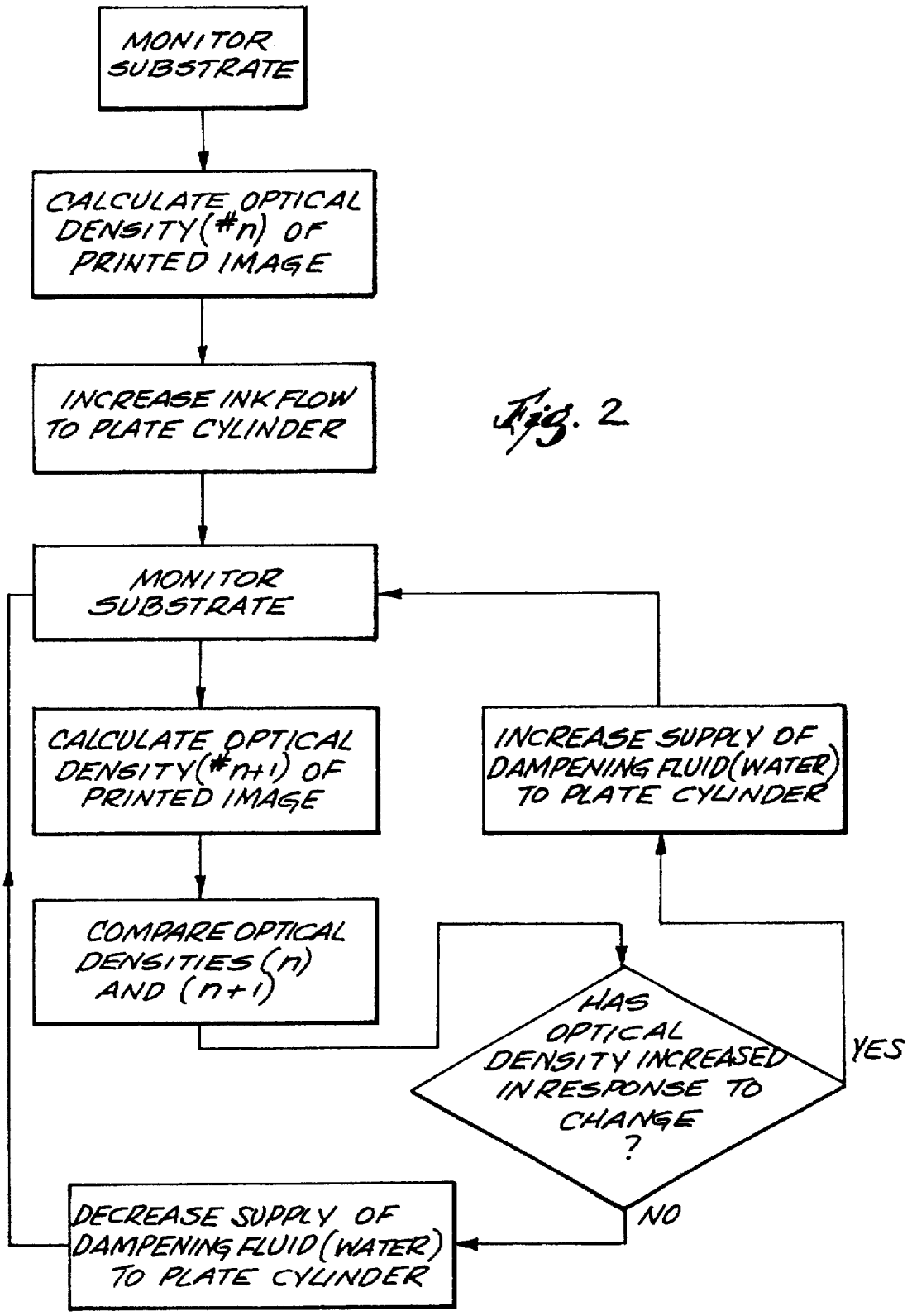
FIG. 2 is a flow-chart depicting the method of regulating the dampening fluid in a printing press using the optical density measured from the color patch.

Once the optical density has been calculated, the computer utilizes an algorithm to determine whether the appropriate amount of dampening fluid is being applied to the plate cylinders 24 and 28. In the embodiment illustrated in the drawings, the dampening fluid is water. FIG. 2 is a flow chart depicting the computer algorithm. As shown in FIG. 2, the algorithm corrects for changes in optical density by learning what corresponding changes in optical density can be expected when a change in the amount of ink applied to the plate cylinders 24 and 28 is made. The computer then calculates the optical density of the printed image and determines whether the ink level is proper. If the ink level is proper, then no change is made to the ink key positions. However, if the ink level is improper, then the computer changes key position to increase the amount of ink on the plate cylinders 24 and 28, and again monitors the substrate to determine the optical density thereof. If, as a result of the change in ink key position, the computer does not see the expected change in the optical density of the image, the computer assumes that the amount of water being supplied to the plate cylinders 24 and 28 is too high. The computer then decreases the amount of water supplied to the plate cylinders 24 and 28 and again checks to see a corresponding change in the optical density of the image.

If the computer changes key position to increase the amount of ink on the plate cylinders 24 and 28 and does see the expected corresponding increase in the optical density of the image, then the computer determines whether the ink and dampening fluid are in balance. If the ink and dampening fluid are in balance, then no change is made to the supply of dampening fluid to the plate cylinders 24 and 28. If however, the ink and dampening fluid are not in balance, then the computer assumes that there is too little dampening fluid, and therefore, the computer increases the supply of dampening fluid to the plate cylinders 24 and 28.

In one embodiment of the invention, the portion of the color bar from which the optical density is calculated is a specific reference area of the color bar where print quality is first naturally affected by the condition of low water supply to the plate cylinder 24 and 28. This portion of the color bar is referred to as a "dry up indicator". In another embodiment, the "dry up indicator" portion of the plate cylinder 24 and 28 is treated to artificially make that portion of the plate cylinder responsible for printing the "dry up indicator" slightly less receptive to water than the rest of the plate cylinder thereby enhancing the affect that a low water condition has on the "dry up indicator".

The calculation of the optical density of the printed image is performed as follows. The camera assembly 36 includes an illumination system 38 and an image recording device 40. Additionally, printing system 10 includes a camera positioning unit 34, a computer 32, and a web stabilizer 39.

In general operation, the camera positioning unit 34 moves the camera assembly 36 to a first position on the web 12. A printed image is illuminated by the illumination system 38 and the image recording device 40 records an image signal which is representative of the printed image within the field of view 56.

The illumination system 38 is synchronized with the movement of the web 12 such that the recorded image signal includes a portion of the color bars. The computer 32 may be of the conventional type including a 486 or Pentium microprocessor and PC architecture. Computer 32 includes random access memory 33 (semiconductor memory and/or disk drive storage) and image capture circuitry 48 which interface with the camera assembly 36.

Computer 32 is connected to camera positioning unit 34 by data bus 54, and computer 32 sends control signals to the camera positioning unit 34. The camera positioning unit 34 is mechanically coupled to camera assembly 36 and moves the camera assembly 36 in a direction perpendicular to the web motion, termed the lateral direction (X-axis, see FIG. 7). The purpose of moving the camera assembly 36 across the web 12 is to allow selective image recording of lateral portions of the printed image on web 12. The camera assembly 36 records the printed image within the field of view 56 for various positions of the camera assembly 36 across the web 12. Web 12 is moving in the Y direction so that circumferential or Y-axis positioning by unit 34 is not necessary because the timing of the strobe light in the illumination system 38 effectively provides circumferential positioning relative to moving web 12, as further explained below. It is also contemplated that a camera positioning unit not be utilized, if, for example, a plurality of cameras are combined to obtain a field of view that covers all required areas of the web 12.

Stabilization may be necessary to reduce the web motion toward and away from the camera assembly 36. This motion is termed web flutter. Web flutter will cause the image to sometimes be out of focus and will cause the magnification of the image to change. Stabilizer 39 can be any mechanism which dampens the flutter of web 12 to within acceptable limits of depth-of-field for recording the printed image on the web 12 by the camera assembly 36, without causing the ink to smear. Web stabilizer 39 is preferably a non-invasive web stabilizer such as that disclosed in U.S. Pat. No. 4,913,049 entitled "Bernoulli Effect Web Stabilizer." A non-invasive stabilizer is one which does not make physical contact with the web 12.

If the web 12 is transparent or translucent, accurate optical density measurements will require that light reflected back through the web 12 be minimized. This can be accomplished by providing a black backing behind the web 12, providing a large open cavity behind the web 12 such that little light will be reflected through the web 12, or utilizing a black roller if the web 12 is stabilized by imaging on a roller.

The camera assembly 36 and camera positioning unit 34 may be mounted on the press anywhere after the ink has been applied to the web 12. For example, in a heatset web offset press, the color measurement system may be mounted between the last print unit and the oven, directly after the oven, on the chill rolls, or after the chill rolls. If optical density measurements are required in the absence of other inks, or if the measurement is required immediately subsequent to printing, it may be advantageous to mount the color measurement system between print units.

Figure 7:
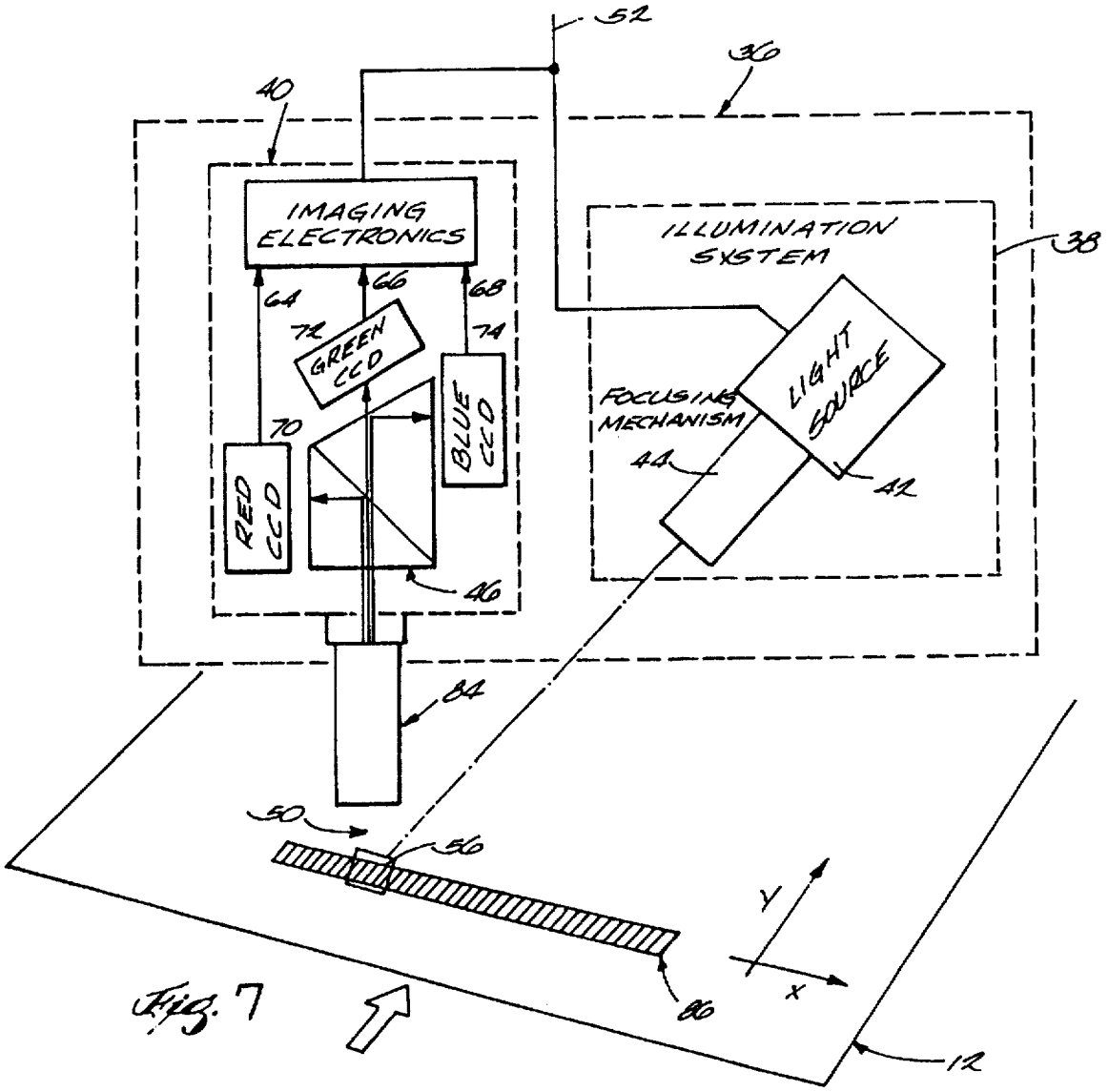
FIG. 7 illustrates a camera assembly from the printing system shown in FIG. 1, and a printed image within the field of view of the camera assembly.

In the preferred embodiment, as shown in FIG. 7, the camera assembly 36 includes an image recording device which is a CCD color camera having red (R) 64, green (G) 66, and blue (B) 68 channels. For example, a Sony XC003 3-chip CCD color video camera may be used as the image recording device 40. This camera uses a dichroic prism 46 to separate reflected light from the printed image on the web 12 into a red channel 64, a green channel 66, and a blue channel 68, each channel including a separate CCD imager, 70, 72, and 74 respectively. Each of the three channels of the video camera is coupled to the computer 32 via signal bus 52, and each channel is configured to produce a recorded image signal of the printed image within the field of view 56 on web 12.

Figure 4A:
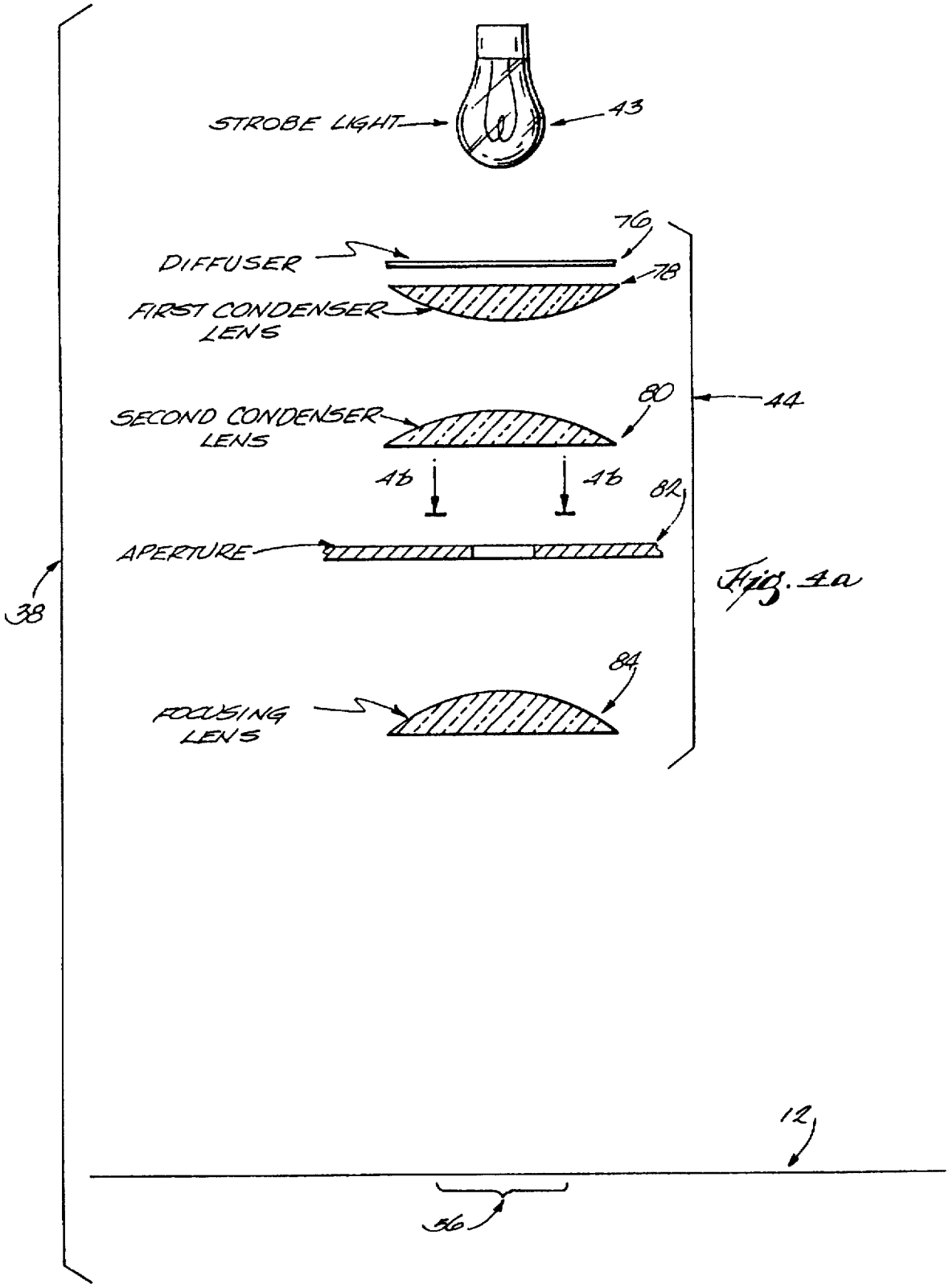
FIG. 4(*a*) illustrates a condenser-lens arrangement for the printing system of FIG. 1.

As shown in FIGS. 2 and 4(*a*), the illumination system 38 includes light source 42 (only one shown) and a focusing mechanism 44. Control signals from the computer 32, corresponding to when the color bar is within the field of view 56, are sent via signal bus 52 to indicate when the web 12 should be illuminated by the light source 42. In the preferred embodiment, pulsed xenon strobe lights with a pulse duration of approximately one microsecond are utilized. With a web speed of 3500 feet per minute and a field of view of roughly 2×1.8 inches, a one microsecond illumination time is preferred to minimize the amount of movement of the printed image during the time the image recording device 40 is quantifying the amount of incoming light reflected from the web 12. By way of example, the light source 42 could include a strobe light assembly utilizing EG&G Strobes FX-199 with power supplies PS-350-1.

The illumination control signals from the computer 32 are produced, for example, by conventional means utilizing rotational position information generated from a sensor placed on one of the blanket cylinders (22 or 26), knowledge of the speed of the web 12, and knowledge of the distance between the image recording device 40 and the blanket cylinder (22 or 26).

The focusing mechanism 44 efficiently concentrates the light emitted from the light source 42 onto the image within the field of view 56. When the strobe light is flashed, the image recording device 40 records the image within the field of view 56, which contains portions of the color bars.

Figure 3A:
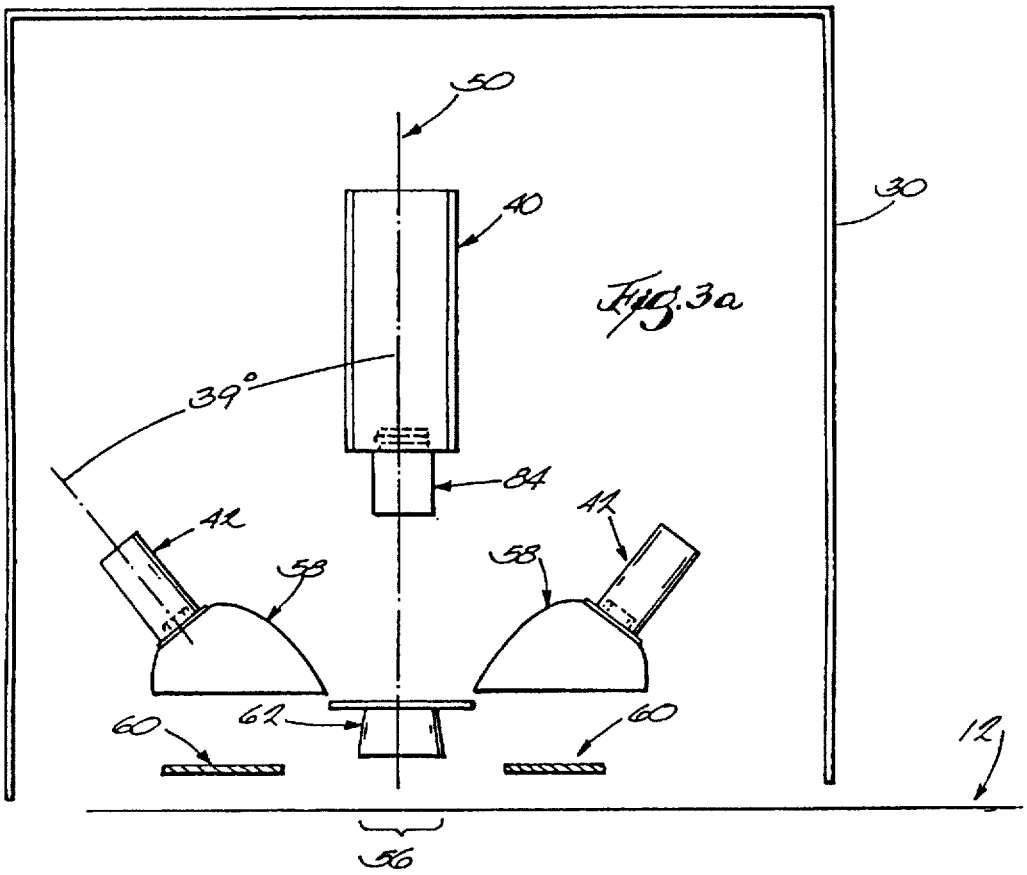
FIG. 3(*a*) illustrates a reflector, hood, and baffle arrangement for the printing system of FIG. 1.

As shown in FIG. 3(*a*), in the preferred embodiment, the camera 40 is mounted perpendicularly to the web 12 and the field of view 56 preferably is illuminated with two light sources 42.

The camera assembly 36 preferably is mounted in a light-tight housing to minimize the effects of ambient light on the printed image. In general, ambient light will increase the measured reflectance, and will do so in an uncontrolled manner.

Referring back to FIG. 7, the preferred embodiment of the video camera used in camera assembly 36 includes three CCD imagers 70, 72, 74 each of which provides a resolution of 768 pixels by 494 pixels (X direction by Y direction). A typical CCD imager provides approximately a 4:5 picture aspect ratio such that the field of view of the image recording device will be 2" (x-axis) by 1.8" (y-axis). The image recording device 40 is preferably mounted perpendicularly to the web 12, providing a working distance to the web 12 of approximately six inches. The camera lens 84 in the preferred embodiment is a Sony VCL-16WM 16 mm lens. By way of modification, future developments or different application requirements may make different pixel resolutions, field of view size and working distance preferable.

Referring back to FIG. 1, image capture circuitry 48 includes image capture boards which are connected to the expansion bus of computer 32. By way of example, the image capture circuitry may be of the bus board type manufactured by Synoptics of England SPR4000SCIB with 32 MB RAM which includes an A/D converter, and "Shademaster" diagnostic display driver. The vector signal processing library from Kuck and Associates of Urbana, Illinois, may be used to optimize processing speed.

Signal bus 52 transmits recorded image signals from camera assembly 36 to the computer 32, and camera control instructions from computer 32 to camera assembly 36. Image capture circuitry 48 is configured to produce a captured image signal array by converting the recorded image signals into an array of digital signals, of size 640× 480 elements.

Three arrays are generated corresponding to information from each of the three color channels 64, 66, and 68 in FIG. 7. Each captured image signal array element contains an 8-bit "gray value" which is representative of the amount of light reflected from the corresponding area of the printed image within the field of view 56 and onto the corresponding CCD imager. The camera and the image capture boards are calibrated for each channel such that the output of the image converter circuit for a white reference image will have a gray value between 240 and 250 (decimal), while a black reference image, with the lens cover on, will have a gray value between 0 and 10 (decimal). The captured image signal arrays 160, 186 are stored in memory 33 of computer 32.

Figure 5A:
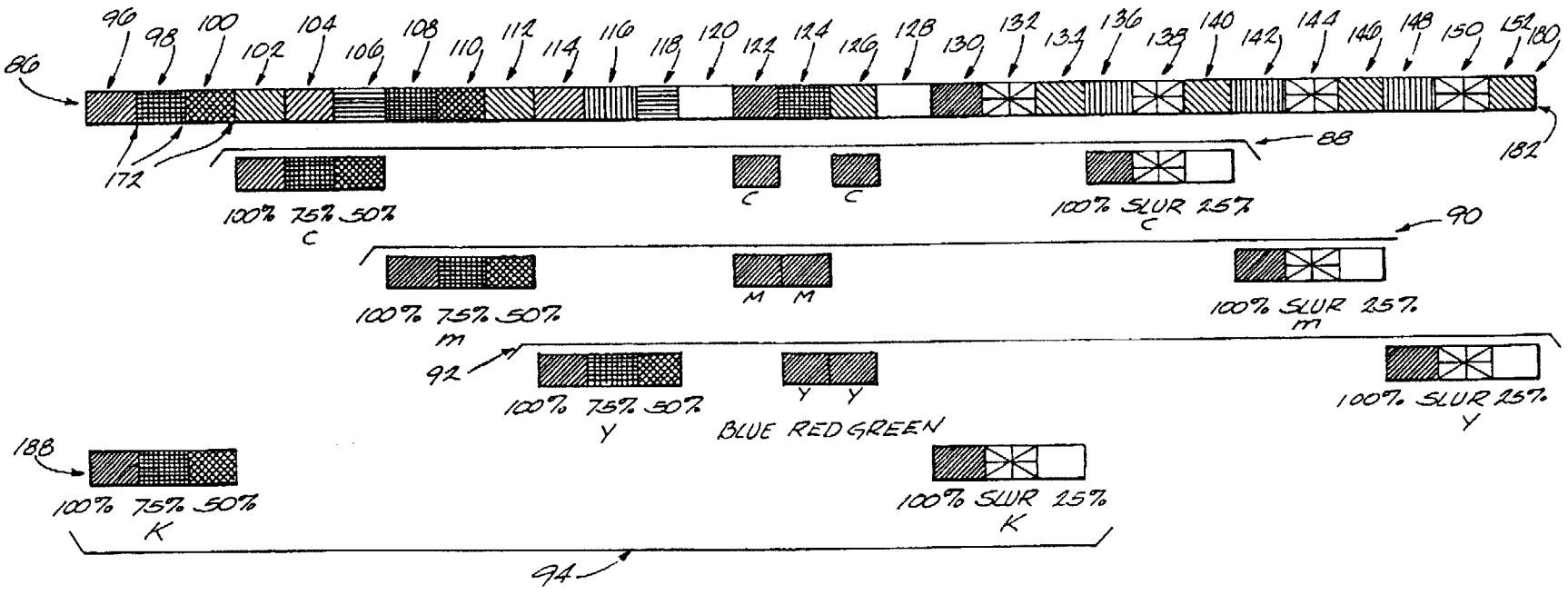
FIG. 5(*a*) illustrates a typical color bar printed by the printing system of FIG. 1.
Figure 5B:
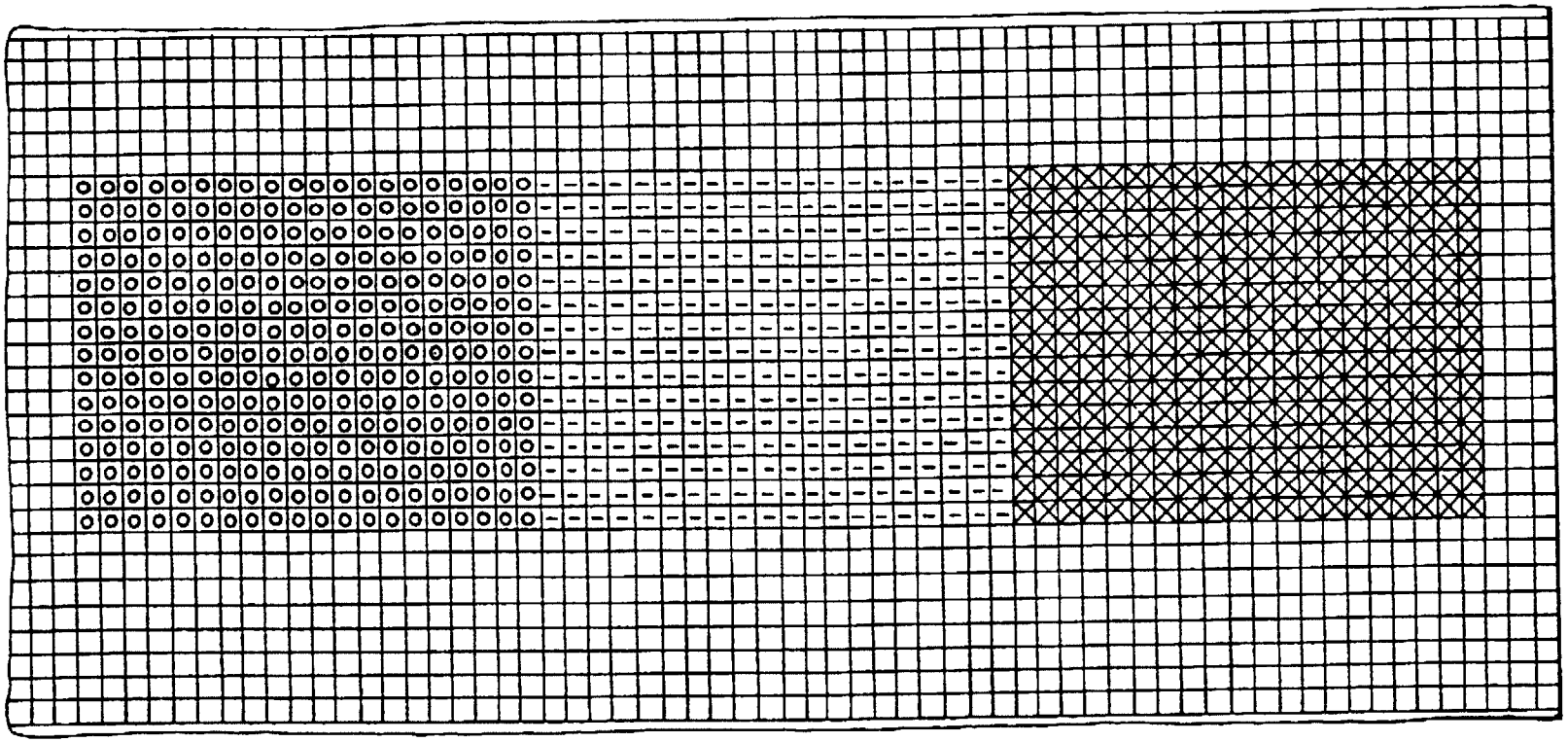

A representative embodiment of a color bar 86 is shown in FIG. 5(*a*). The color patches are arranged side by side in a color bar across the web 12. Typically, this series of color patches is repeated across the web 12. Color bar is comprised of cyan, magneta, yellow, and black components. By way of illustration, color bar 86 may include the following color patches: black 100% 96, black 75% 98, black 50% 100, cyan 100% 102, cyan 75% 104, cyan 50% 106, magenta 100% 108, magenta 75% 110, magenta 50% 112, yellow 100% 114, yellow 75% 116, yellow 50% 118, white 120, blue 122, red 124, green 126, white 128, black 100% 130, black slur 132, black 25% 134, cyan 100% 136, cyan slur 138, cyan 25% 140, magenta 100% 142, magenta slur 144, magenta 25% 146, yellow 100% 148, yellow slur 150, yellow 25% 152; where 100% represents full tone of the ink, 50% represents half tone, and so forth.

By way of example, the field of view 56 may be aligned with the axis of the color bar such that the data representing the color bar in the captured image signal array is located in adjacent rows of the captured image signal array, as illustrated in FIG. 5(*b*). In this orientation, lateral direction on the web is aligned with the X direction of the camera and circumferential direction on the web is aligned with the Y direction of the camera. As illustrated, the field of view 56 may contain only a portion of the color bar.

Figure 6:
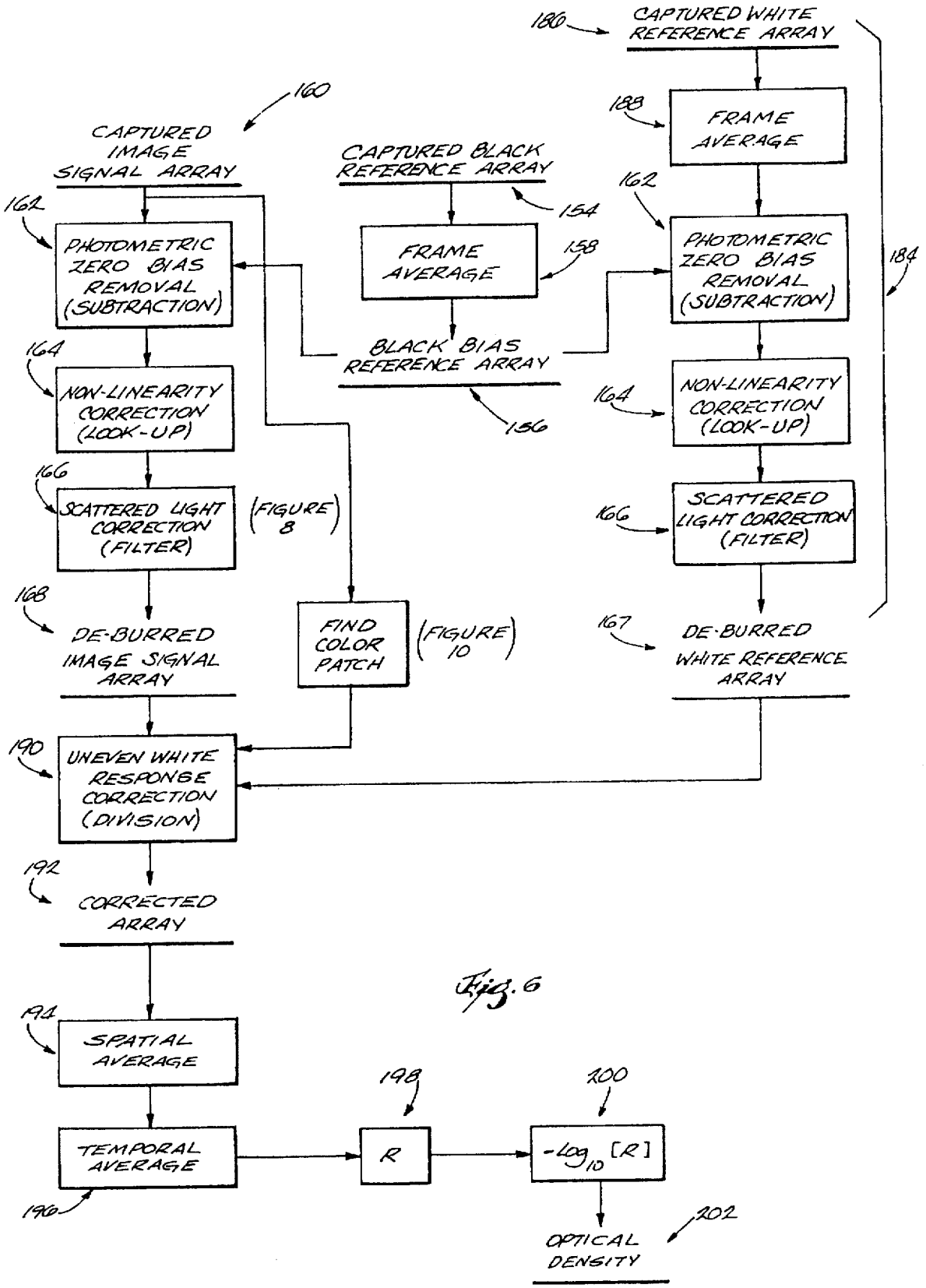
FIG. 6 is a flow-chart of corrections and computations performed on the captured image signal array to obtain optical density of a color patch.

Computer 32 operates as a processing circuit, as shown in FIG. 6, to manipulate the captured image signal array for each color channel to correct for photometric zero, system nonlinearities, scattered light, and uneven white response. Also, computer 32 operates as an optical density conversion circuit by locating color patch boundaries within the captured image signal array and calculating the optical density of each individual color patch within the field of view, as described in United States patent application Ser. No. 08/434,928, which was filed on May 4, 1995, and which is incorporated herein by reference.

When a system for monitoring color is first installed on a press, the exact relationship between signals from the press and the appearance of the color bar under the camera may be unknown, or at least cumbersome to determine. One means for determining this system calibration is to program the computer 32 to act as a color bar searching circuit.

The color bar search algorithm begins by collecting an image at one candidate position, where position is taken to refer to a particular timing between press signals and strobe flash. This image is analyzed according to the previously disclosed algorithms to determine whether the image contains a valid color bar.

If the color bar has been found, its vertical position in the image is noted and the position is amended so as to bring the color bar 86 to the center of the image 204. This is the calibrated position which is to be used for subsequent image collection.

If the color bar is not found in the image, the position is incremented so as to collect an image which has partial overlap with the first image. The process is repeated until either the color bar is located, or the images have been collected which cover all positions on the impression cylinder 24. If the latter occurs, an error is reported.

Referring back to FIG. 6, computer 32 is also programmed to operate as an uneven white response correction circuit 190. This correction involves dividing, element by element, the filtered image signal array by a filtered white reference array 167. The filtered white reference array is generated from a captured white reference array by applying the photometric zero correction 162, the nonlinearity correction 164, and the scattered light correction circuits 166 to the captured white reference array 168. The white reference array may be an image of a uniform white reference tile, an image of a section of roller which has been uniformly whitened, or a portion of the web which has not been printed on. The uneven white response correction corrects for vignetting in the lens, nonuniformity of illumination across the field of view 56, and nonuniform camera pixel sensitivity.

If a portion of the web is imaged to create the white reference array 167, there is a side benefit that the densities calculated will be "paper reference" densities, rather than absolute densities. Paper reference densities are more useful in the printing industry since they more directly relate to ink film thickness. To reduce errors due to variations in strobe intensity, it is also contemplated to further use a white patch (120, 128) as a white reference.

Note that the location of each color patch (96–152) within the captured image signal array has been determined at this point. To minimize computations, uneven white response correction need only be performed on the relevant color patch elements of the filter corrected image signal array.

Once corrections have been performed, the elements corresponding to an individual color patch are averaged by spatial averaging circuit 194. Optionally, temporal averaging 196 may also be performed by obtaining several frames from the camera and averaging the reflectances computed for corresponding patches.

In the preferred embodiment, the size of the field of view is 2.0"×1.8". Multiple considerations go into the selection of the size of the field of view. The first consideration is the size of the color patches. The field of view must be small enough such that each individual color patch consists of multiple elements of the captured image signal array. This allows for multiple elements to be averaged and also allows for elements near the boundaries of the color patch to be disregarded. The second consideration is the pixel resolution of the camera. Increased camera resolution will allow for more pixels in the same field of view. A third consideration is the avoidance of moire patterns between the CCD pixels and the halftone dots in the printed color bars. For any set of conditions of pixel resolution and halftone dot spacing, there will be a range for the field of view which should be avoided.

Finally, optical density D may be calculated as: D=−log [R] for each of the color patches. The densities thus arrived at are further used in conventional computation. For example, the solid ink density and the density of the corresponding 50% patch (for example, 96 and 100 for black ink) are together used to compute dot gain; the solid ink density and the density of the corresponding 75% patch (for example, 96 and 98 for black ink) are together used to compute print contrast; the solid ink density of an overprint (for example, 122 for cyan) and the corresponding solid ink density 102 are used to compute trap. Together with solid ink density, the dot gain, print contrast and trap may be used for quality control of the print run, for diagnosis of printing conditions or for control of inking levels.

Various features and advantages of the invention are set forth in the following claims.

What is claimed is:

1. A method of controlling the amount of ink and water supplied to the plate cylinder of a web offset press, the web offset press operating to print an image on a travelling substrate, said method comprising the steps of:

(A) monitoring a characteristic of the substrate;

(B) changing by a known quantity the amount of ink supplied to said plate cylinder in response to said monitored characteristic;

(C) monitoring the change in said characteristic after said step (B) to determine whether the monitored characteristic has changed in response to said step (B) to an expected characteristic level; and (D) decreasing the amount of water supplied to the plate cylinder when said monitored characteristic does not change to said expected characteristic level in response to said step (B).

2. A method as set forth in claim 1 and further comprising the step of (E) monitoring said characteristic to detect the change in said characteristic in response to said step (D).

3. A method as set forth in claim 1 wherein said characteristic is a one of reflectance or optical density.

4. A method as set forth in claim 1 wherein said method further includes the step of (F) printing a reference area on the substrate prior to said step (A), said reference area being an area on the substrate that is sensitive to the condition of too little water supplied to the plate cylinder.

5. A method of controlling the amount of ink and water supplied to the plate cylinder of a web offset press, the web offset press operating to print an image on a travelling substrate, said method comprising the steps of:

(A) printing an image including a reference area on the substrate, the reference area being a portion of the image that is sensitive to the condition of too little water supplied to the plate cylinder;

(B) monitoring the optical density of the reference area portion of the substrate;

(C) changing by a known quantity the amount of ink supplied to said plate cylinder in response to said optical density;

(D) monitoring the change in said optical density after said step (C) to determine whether the optical density of ink supplied to the substrate has changed in response to said step (C) to reach an expected optical density;

(E) decreasing the amount of water supplied to the plate cylinder when said optical density does not change to said expected optical density in response to said step (C); and (F) monitoring said optical density to detect the change in said optical density in response to said step (E).

6. The method of claim 5 wherein the step of monitoring the optical density of the reference area portion of the substrate includes comparing a measured optical density value to a desired optical density value.

7. A method of controlling the amount of ink and water supplied to the plate cylinder of a web offset press, the web offset press operating to print an image on a travelling substrate, said method comprising the steps of:

(A) printing an image including a reference area on the substrate, the reference area being a portion of the image that is sensitive to the condition of too little water supplied to the plate cylinder;

(B) comparing a measured optical density of the reference area with a desired optical density of the reference area;

(C) changing by a known quantity the amount of ink supplied to said plate cylinder in response to said comparing step;

(D) monitoring the change in said optical density after said step (C) to determine how the optical density of the reference area has changed in response to said step (C);

(E) decreasing the amount of water supplied to the plate cylinder when said optical density does not change to a predetermined optical density in response to said step (C).

* * * * *